US010527278B2

(12) United States Patent
Pittser et al.

(10) Patent No.: US 10,527,278 B2
(45) **Date of Patent: *Jan. 7, 2020**

(54) RADIANT TO CONVECTION TRANSITION FOR FIRED EQUIPMENT

(71) Applicant: PCL Industrial Services, Inc., Denver, CO (US)

(72) Inventors: Mark Elmer Pittser, Bakersfield, CA (US); Zachary Mark Smith, Bakersfield, CA (US); Garry Loren Barker, Bakersfield, CA (US)

(73) Assignee: PCL INDUSTRIAL SERVICES, INC., Denver, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/908,125

(22) Filed: Feb. 28, 2018

(65) Prior Publication Data

US 2018/0187882 A1 Jul. 5, 2018

Related U.S. Application Data

(63) Continuation of application No. 14/025,280, filed on Sep. 12, 2013, now Pat. No. 9,939,149.

(60) Provisional application No. 61/860,163, filed on Jul. 30, 2013.

(51) Int. Cl.

| | |
|---|---|
| ***F22B 29/06*** | (2006.01) |
| ***F22B 13/04*** | (2006.01) |
| ***F22B 15/00*** | (2006.01) |

(52) U.S. Cl.

CPC ..... *F22B 29/06* (2013.01); *F22B 13/04* (2013.01); *F22B 15/00* (2013.01)

(58) Field of Classification Search

CPC ..... F22B 29/06; F22B 15/00; F22B 13/04; F22B 21/346; F22B 13/023; F28F 9/26; F28F 9/0263; F28F 9/0282; F28F 2009/029

See application file for complete search history.

(56) References Cited

U.S. PATENT DOCUMENTS

| | | | | |
|---|---|---|---|---|
| 462,929 A | | 12/1891 | Heberer | |
| 2,230,384 A | | 2/1941 | O'Conner | |
| 3,163,153 A | * | 12/1964 | Griffin | F22B 1/1861 122/356 |
| 4,289,093 A | * | 9/1981 | Coggins | F22B 21/065 122/197 |
| 4,290,388 A | * | 9/1981 | Ruhe | E21B 36/025 122/235.14 |

(Continued)

OTHER PUBLICATIONS

Petroleum, Petrochemical, and Natural Gas Industries—Fired Heaters for General Refinery Service, ANSI/API Standard 560/ISO, 4th Edition, Aug. 2007, pp. 10-14.

*Primary Examiner* — Steven S Anderson, II
(74) *Attorney, Agent, or Firm* — Holzer Patel Drennan

(57) ABSTRACT

Modern steam generators typically include a radiant section and a convection section. Due to differing performance requirements of the radiant and convection sections, the radiant section often has a round cross-section, while the convection section often has a rectangular cross-section. Previous designs utilized a target wall to affect the transition. An angled transition section is disclosed herein that substantially eliminates the target wall and/or the reverse target and provides a corresponding improvement in steam generator efficiency.

20 Claims, 8 Drawing Sheets

(56) References Cited

U.S. PATENT DOCUMENTS

| | | | | |
|---|---|---|---|---|
| 5,555,718 | A | 9/1996 | Anderson et al. | |
| 5,771,963 | A | 6/1998 | Blangetti et al. | |
| 6,536,380 | B1 * | 3/2003 | Kral | F22B 21/346 122/406.3 |
| 6,887,954 | B2 | 5/2005 | Maurel | |
| 2002/0017251 | A1 | 2/2002 | Wittchow | |
| 2003/0145769 | A1 * | 8/2003 | Vatsky | F23K 3/02 110/341 |
| 2007/0266962 | A1 | 11/2007 | Stone et al. | |

* cited by examiner

RADIANT TO CONVECTION TRANSITION FOR FIRED EQUIPMENT

CROSS-REFERENCE TO RELATED APPLICATIONS

The present application is a continuation application of U.S. application Ser. No. 14/025,280 filed Sep. 12, 2013, now U.S. Pat. No. 9,939,149, entitled "Radiant To Convection Transition for Fired Equipment" which claims the benefit of priority to U.S. Provisional Patent Application No. 61/860,163, entitled "Radiant to Convection Transition for a Steam Generator" and filed on Jul. 30, 2013, which is specifically incorporated by reference herein for all that it discloses or teaches.

BACKGROUND

An example type of fired equipment, a steam generator utilizes a heat source to convert a liquid-phase fluid (e.g., water) to a gaseous-phase fluid (e.g., steam). In one implementation, the steam generator construction includes one or more tubes through which the fluid is pumped under pressure. The fluid tubes pass through the steam generator in a manner that transfers heat from the heat source to the fluid within the tubes. The fluid vaporizes into pressurized saturated steam within the fluid tubes and is discharged from the steam generator. The pressurized steam or other heated fluid can then be used for power generation (e.g., via a steam turbine), heating (e.g., via a heat tracing system, a heat exchanger, and/or a radiator), enhanced oil recovery (EOR, e.g., steam injection), for example. The heat source can be derived from combustion of one or more fuels (e.g., coal, oil, produced gas, waste gas, natural gas, propane, biomass, etc.), for example.

In various implementations, the fluid flow rate through the tubes is adjustable, according to the quantity of steam desired. Further, the burner heat output may also be adjusted to maintain a constant working temperature within the steam generator or a desired steam quality output from the steam generator. Still further, the burner output may be varied based on the flow rate of fluid being pumped through the fluid tubes. Thus, the burner output may be adjusted by open-loop or closed-loop control using the fluid throughput and/or measured temperature within the steam generator as control variables, for example.

Steam generators often include different sections that use different fluid tube arrangements depending on the primary mode of heat transfer intended for that particular section. For example, a radiant section may position the fluid tubes in line-of-sight with the heat source (e.g., a flame), but not directly in the flame because the high localized flame temperature may exceed the yield strength of the fluid tubes. Further, a convection section may position the fluid tubes directly in the flow path of the combustion gases downstream of the flame in order to maximize radiant and convective heat transfer of combustion gases to the fluid tubes. A target wall provides a distinct transition point from the radiant section and the convection section.

Effective transitions between different sections of a steam generator may be difficult to achieve due to the differing requirements of the different sections of the steam generator. Further, manufacturing and assembly challenges have previously limited the scope of options available for shaping effective transitions between different sections of the steam generator.

SUMMARY

Implementations described and claimed herein address the foregoing problems by providing fired equipment comprising a cylindrical radiant section having a circular output with a diameter substantially the same as a diameter of the cylindrical radiant section.

Implementations described and claimed herein address the foregoing problems by further providing a method comprising outputting combustion gases from a cylindrical radiant section of fired equipment via a circular output with a diameter substantially the same as a diameter of the cylindrical radiant section.

Implementations described and claimed herein address the foregoing problems by further still providing a steam generator comprising a transition section connected to a circular furnace output, the transition section having a circular input with a diameter substantially the same as the circular furnace output, the transition section further having a rectangular output.

Implementations described and claimed herein address the foregoing problems by further yet providing a method of manufacturing a transition section of a steam generator comprising forming a circular input of the transition section with a diameter substantially the same as a circular furnace output of the steam generator smoothly transitioning to a rectangular output of the transition section.

Other implementations are also described and recited herein.

BRIEF DESCRIPTIONS OF THE DRAWINGS

DETAILED DESCRIPTIONS

The presently disclosed technology may apply to any fired equipment that utilizes a combusting heat source to transfer thermal energy to a fluid running within a fluid path in conductive, convective, and/or radiative communication with the combusting heat source. Specific applications for the presently disclosed technology include steam generators (including once-through steam generators), boilers, furnaces, fired heaters, and process heaters, for example. Further, the fluid running within the fluid path may include water, oil, or another process fluid.

Figure 1:
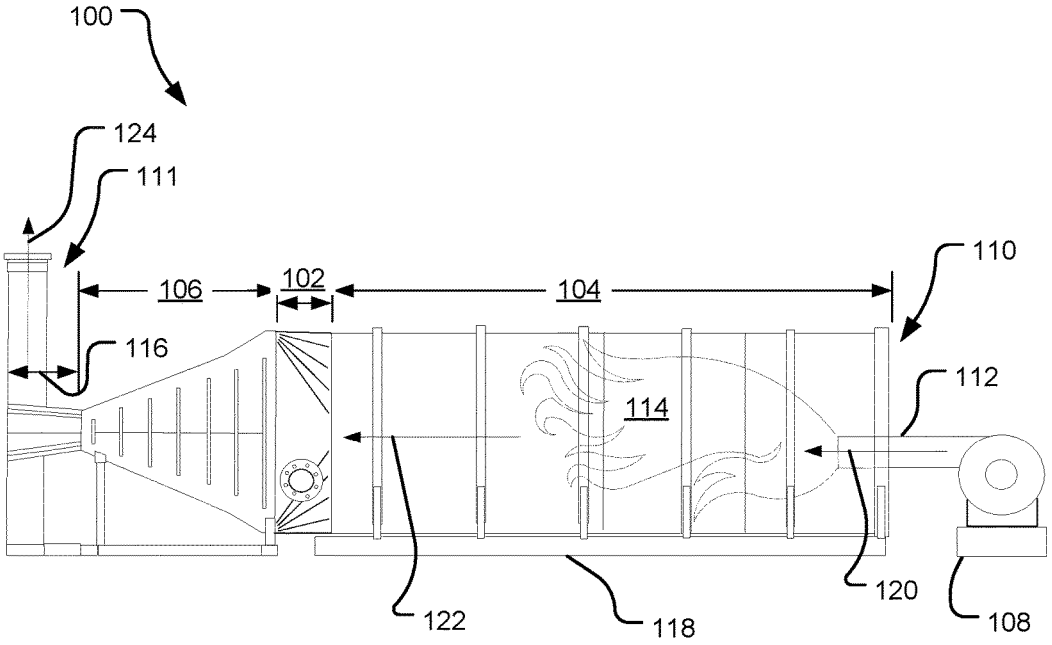
FIG. 1 is an elevation exterior view of an example steam generator with an angled transition from a radiant section to a convection section.

FIG. 1 is an elevation exterior view of an example steam generator 100 with an angled transition 102 from a radiant section 104 to a convection section 106. The steam generator 100 is attached to a base frame 118 (e.g., a steel frame) and includes a blower/fan 108 that supplies combustion air to a burner 112. The burner 112 protrudes through a first end 110 (i.e., a burner wall) of the generator 100, as illustrated by arrow 120. The burner 112 combines a predetermined flow rate of fuel and combustion air, ignites the fuel/air combination, and combusts the ignited fuel/air within the generator 100. A flame 114 extends into the generator 100 from the burner 112 and is carried downstream into the generator 100 by the flow of the combustion air and combusted products (referred to in bulk as combustion gases) through the generator 100 as illustrated by arrow 122. In some implementations, the radiant section 104 is referred to as a furnace.

The flame 114 protrudes into the radiant section 104 of the generator 100 and may have a conical shape. The radiant section 104 utilizes primarily thermal radiation generated by the flame 114 to heat a fluid (e.g., water or oil) flowing through a circuit of pipes or tubes (not shown) generally located at the interior periphery of the radiant section 104 (see e.g., circuit of pipes 524 of FIG. 5B). In one implementation, the pipes flow pressurized feed water to be converted into steam using the heat generated by the flame 114. Since the flame 114 is hot enough to potentially damage the pipes if allowed to be in direct contact with the pipes, the pipes are arranged at the interior periphery of the radiant section 104, while the flame 114 generally extends through the interior center of the radiant section 104 of the generator 100. As a result, convective heat transfer to the water within the circuit of pipes in the radiant section 104 is limited. However, significant radiant heat is transferred from the flame 114 to the circuit of pipes because the pipes are in line-of-sight with the flame 114. In various implementations, radiant heat transfer comprises greater than 80% of the overall heat transfer to the tubes in the radiant section 104. In various implementations, the radiant section 104 includes 2,000-3,500 square feet of outside pipe surface area. In various implementations, the radiant section 104 is constructed with a metal shell with refractory and/or ceramic fiber insulation for limiting heat loss from the generator 100.

The radiant section 104 is connected to the convection section 106 via the angled transition 102. The convection section 106 utilizes primarily thermal convection from the combustion gases to heat fluid flowing through another circuit of pipes that occupy much of the interior volume of the convection section 106 (see e.g., circuit of pipes 525 of FIG. 5B). The convection section 106 may include one or more rows (e.g., three rows) of shock tubes at the start of the convection section 106. The shock tubes maximize radiant heat transfer of the convection section 106 (see e.g., FIG. 4 and detailed description thereof).

The convection section 106 is located downstream of the flame 114 and the temperature of the combustion gases decreases as the combustion gases flow through the radiant section 104. As a result, the combustion gas temperature in the convection section 106 allows the shock tubes to be placed directly in line with the burner flame 114 and not cause a failure of the tubes. The tubes within the convection section 106 occupy much of the interior volume of the convection section 106 causing the combustion gas to flow turbulently around the pipes, thus maximizing convective heat transfer to the fluid within the pipes. In one implementation, the tubes are configured with increasing exterior surface area (e.g., fins) with distance downstream within the convection section 106 in order to maximize heat transfer within the convection section 106. In various implementations, convective heat transfer comprises greater than 50% or greater than 80% of the overall heat transfer to the fluid within the pipes in the convection section 106. In various implementations, the convection section 106 includes 16,000-35,000 square feet of outside pipe surface area (including fins where applicable).

The convection section 106 reduces in interior cross-sectional area, at least in some areas, as the combustion gases move downstream within the convection section 106. This accelerates the combustion gases and aids in convective heat transfer to the fluid within the pipes as the combustion gases become progressively cooler as they move downstream within the generator 100. The convection section 106 is connected to an exhaust transition section 116 at a second end 111 of the generator 100. The combustion gases are then exhausted into atmosphere, reintroduced as flue gas in the generator 100, used for other process needs, processed to satisfy environmental requirements, and/or introduced into another lower temperature heat exchanger (not shown), as illustrated by arrow 124.

In one implementation, the pressurized feed fluid enters the second end 111 of the generator 100. One or more disparate fluid circuits (not shown) may be used. The fluid passes through the circuit of pipes within the convection section 106, where the fluid temperature rises, but the fluid remains in a non-saturated liquid state. The convection section 106 pipes are fluidly connected to the circuit of pipes within the radiant section 104 (e.g., via internal or external connection piping, not shown). The fluid passes through the circuit of pipes within the radiant section 104, where the fluid further heated to a boiling state where it is partially or completely vaporized (i.e., water is converted to steam). The saturated steam mixture is then discharged from the circuit of pipes at the first end 110 of the generator 100.

Due to the differing purposes and requirements of the radiant section 104 and the convection section 106, the radiant section 104 has a circular cross-section and the convection section 106 has a rectangular cross-section. The angled transition 102 allows the circular radiant section 104 to be connected to the rectangular convection section 106 without substantial obstruction (e.g., without a substantial target wall) and without placing any pipes within the convection section 106 substantially outside of the combustion gas flow.

More specifically, in an example conventional steam generator with an abrupt transition, the radiant section 104 effective (or "hydraulic") cross-sectional diameter is substantially equal to or greater than the effective (or "hydraulic") cross-sectional diagonal dimension of the convection section 106. As a result, a target wall is used in the conventional transition to force the combustion gas flow from the circular radiant section 104 to the rectangular convection section 106 (see e.g., see target wall 528 of FIG. 5A) and block radiant energy transfer to the convection section 106. Presence of the target walls lead to inefficiencies within the steam generator 100.

The angled transition 102 allows combustion gases to flow from the radiant section 104 to the convection section 106 without encountering a substantial target wall and blocking radiant energy transfer to the convection section 106. This allows substantially all of the tubes in the convection section 106 to remain within the combustion gases flow. Further, the absence of a substantial target wall reduces or removes potential fatigue or harmonic concentrations that lead to fracture in areas where the metal changes shape abruptly from circular cross-section to a rectangular cross-section.

The various components of the generator 100 may be bolted and/or welded together. Further, higher-temperature components of the generator 100 may be refractory-lined and/or ceramic fiber insulated, while other components may be metal only. The metal used may include steel and various alloys.

Figure 2:
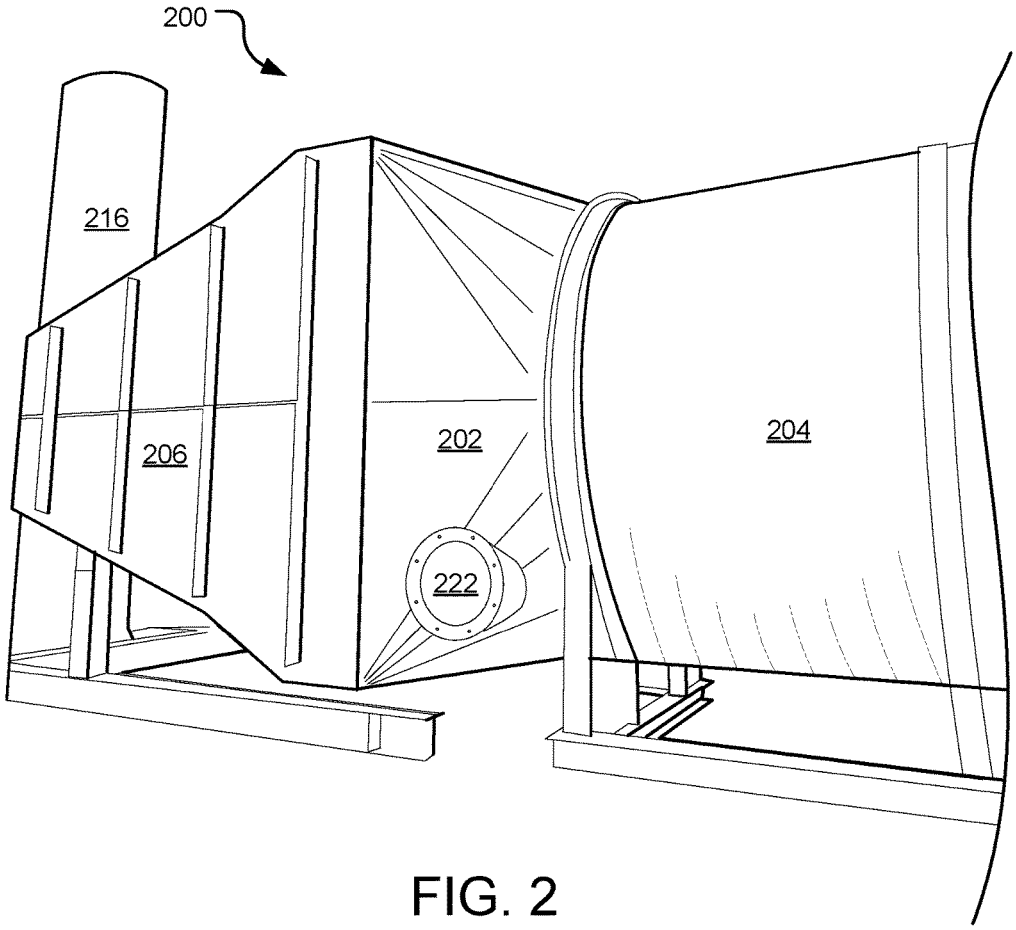
FIG. 2 is a perspective exterior view of an example angled transition from a radiant section to a convection section of a steam generator.

FIG. 2 is a perspective exterior view of an example angled transition 202 from a radiant section 204 to a convection section 206 of a steam generator 200. The radiant section 204 is connected to the convection section 206 via the angled transition 202. The radiant section 204 utilizes primarily thermal radiation to heat fluid flowing through a circuit of pipes (not shown) generally located at the interior periphery of the radiant section 204 (see e.g., circuit of pipes 524 of FIG. 5B). The convection section 206 utilizes primarily thermal convection to heat fluid flowing through another circuit of pipes which occupies much of the interior volume of the convection section 106 (see e.g., circuit of pipes 525 of FIG. 5B). The circuits of pipes are fluidly connected together and flow fluid to be converted into steam using the heat generated within the steam generator 200. Some implementations include multiple discrete sets of pipes within the generator 200. The angled transition 202 also includes access door 222 that permits user access to the interior of the generator 200 for maintenance or repair.

The radiant section 204 has a circular cross-section and the convection section 206 has a rectangular cross-section. The angled transition 202 allows the circular radiant section 204 to be connected to the rectangular convection section 206 without substantial obstruction (e.g., without a substantial target wall) and without locating any pipes within the convection section 206 substantially outside of a combustion gas flow through the generator 200 and out an exhaust section 216 of the generator 200.

Figure 3:
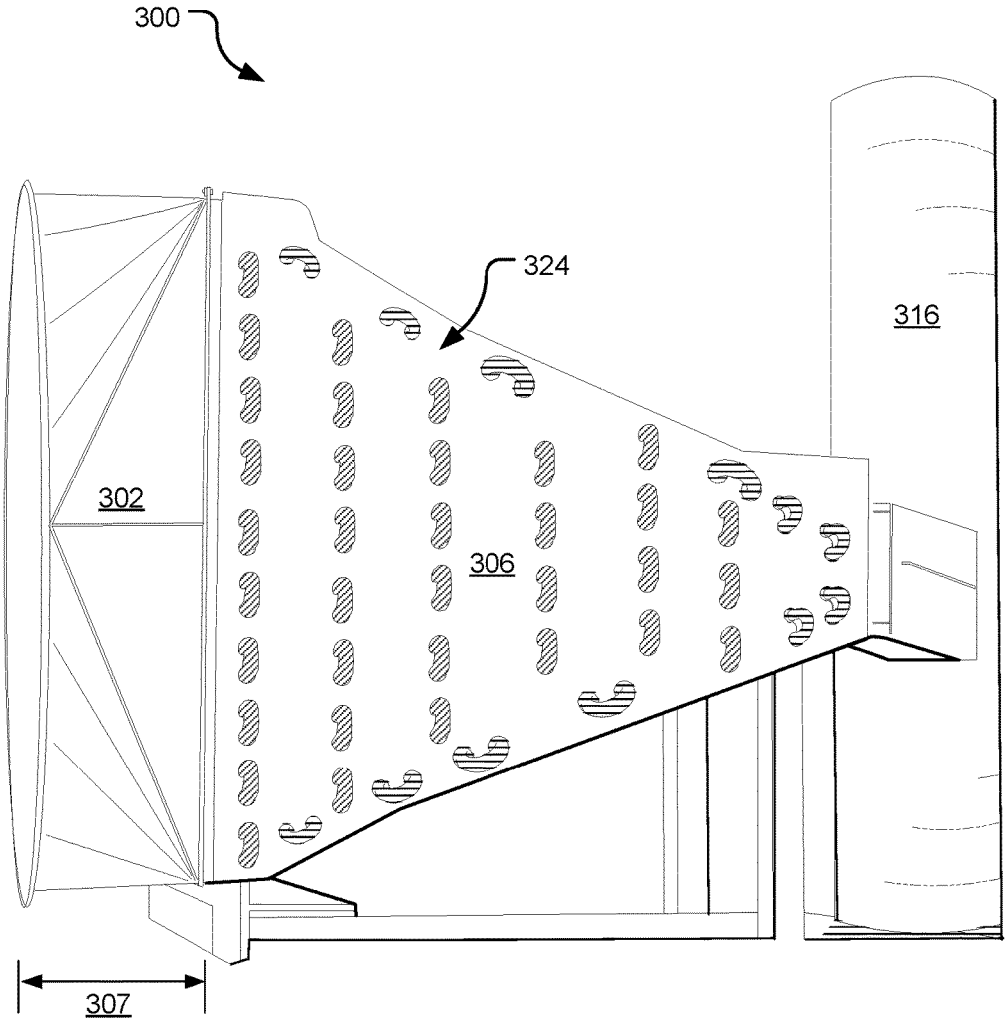
FIG. 3 is a detail elevation exterior view of an example angled transition attached to a convection section of a steam generator.

FIG. 3 is a first detail elevation exterior view of an example angled transition 302 attached to a convection section 306 of a steam generator 300. The convection section 306 utilizes primarily thermal convection to heat fluid flowing through a circuit of pipes 324 that occupy much of the interior volume of the convection section 306 (see e.g., FIG. 6), extending out of and back into the convection section 306 as shown in FIG. 3. The pipes 324 flow fluid to be converted into steam using the heat generated within the steam generator 300.

A corresponding radiant section (not shown) of the generator 300 has a circular cross-section and the convection section 306 has a rectangular cross-section. The angled transition 302 allows the circular radiant section 304 to be connected to the rectangular convection section 306 without substantial obstruction (e.g., without a substantial target wall) and without placing any pipes within the convection section 306 substantially outside of a combustion gas flow through the generator 300 and out an exhaust section 316 of the generator 300. In one implementation, a length dimension 307 of the angled transition 302 is minimized to achieve a low thermal loss out of the angled transition 302 walls. In various implementations, the length dimension 307 ranges from 2½ feet to 6 feet. In other implementations, the length dimension 307 is less than 4 feet.

Figure 4:
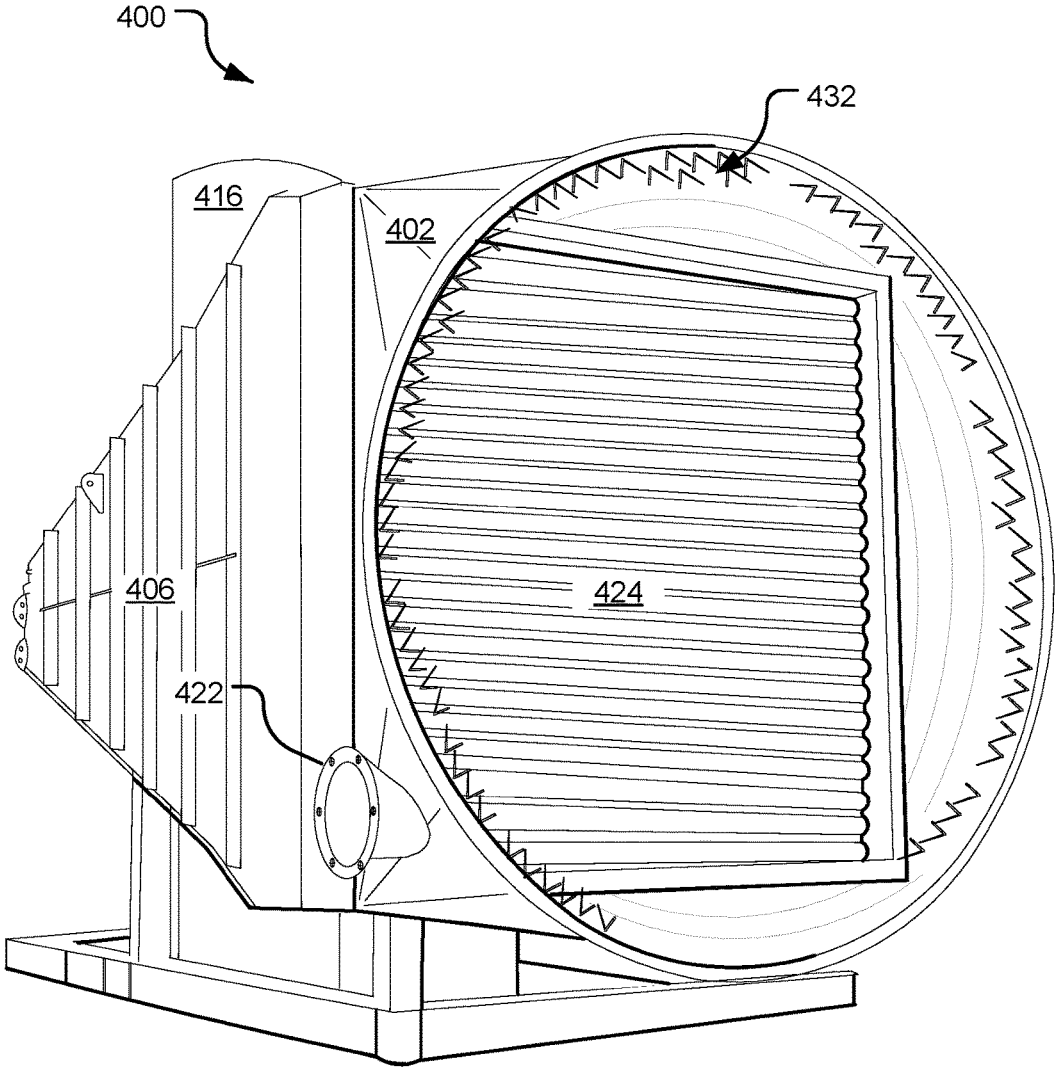
FIG. 4 is a perspective interior view of an example angled transition attached to a convection section of a steam generator.

FIG. 4 is a perspective interior view of an example angled transition 402 attached to a convection section 406 of a steam generator 400. The convection section 406 utilizes primarily thermal convection to heat fluid flowing through a circuit of pipes 424 that occupy much of the interior volume of the convection section 406. The pipes 424 run generally horizontally across the convection section 406, extending out of and back into the convection section 406 (as shown in FIG. 3), and back across the convection section 406 repeatedly. This creates a continuous circuit for flowing fluid to be converted into steam using the heat generated within the steam generator 400.

Further, the circuit of pipes 424 also includes multiple rows (or layers) of pipes behind the depicted row of generally horizontally running pipes. In one implementation, the circuit of pipes 424 includes both shock tubes and fin tubes. Shock tubes absorb direct radiation and shield the remaining convection section tubes (e.g., the fin tubes). In one implementation, the shock tubes are generally round and have a substantial thickness. This makes the shock tubes capable of withstanding significant temperatures and stresses. The fin tubes have an increased exterior surface area as compared to the shock tubes, which optimizes the primarily convective heat transfer to the fin tubes as compared to the primarily radiant heat transfer the shock tubes. In one implementation, the fin tubes include one or more thin flattened fins extending from the tubes. In another implementation, the fin tubes are thinner flattened tubes. As a result, the fin tubes are more effective at transferring convective heat from the combustion gases to the flowing fluid. The shock tubes are depicted in FIG. 4 as the first row (or row) of the circuit of pipes 424. In various implementations, one or more additional rows of shock tubes may run behind the depicted row of shock tubes. The remaining rows of pipes may be fin tubes. In one example implementation, 3 rows of shock tubes are used before transitioning to fin tubes.

The angled transition 402 also includes access door 422 that permits user access to the interior of the generator 400 for maintenance or repair. In some implementations, an overall length of the angled transition 402 is defined by the width of the access door 422 plus fabrication tolerances on each side of the access door 422. Minimizing the overall length of the angled transition 402 positions the shock tubes as close as possible to a corresponding radiant section (not shown) of the generator 400, which maximizes heat transfer to the shock tubes.

The radiant section has a circular cross-section and the convection section 406 has a rectangular cross-section. The angled transition 402 allows the circular radiant section 404 to be connected to the rectangular convection section 406 without substantial obstruction (e.g., without a substantial target wall) and without placing any pipes within the convection section 406 substantially outside of a combustion gas flow through the generator 400 and out an exhaust section 416 of the generator 400.

The angled transition 402 further includes anchors 432 for securing refractory or other insulation (not shown) to the interior walls of the angled transition 402.

Figure 5A:
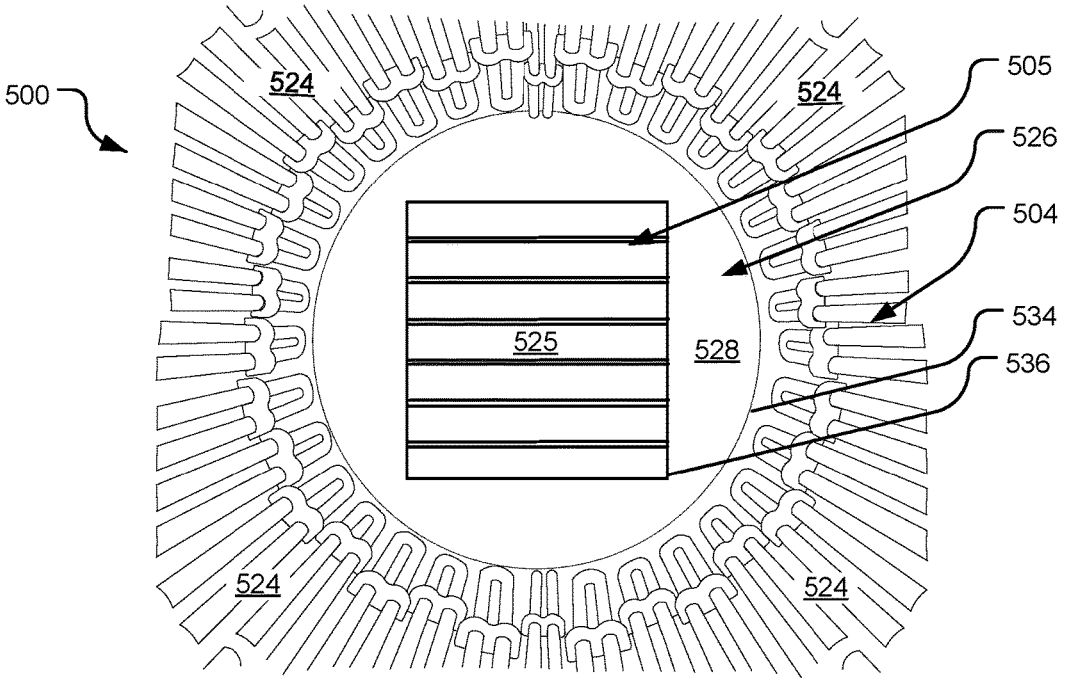
FIG. 5A is an interior view of an example conventional or abrupt transition attached to a convection section of a steam generator.

FIG. 5A is an interior view of an example conventional or abrupt transition 526 connecting a radiant section 504 to a convection section 505 of a steam generator 500. The radiant section 504 primarily utilizes thermal radiation within the generator 500 to heat fluid flowing through a first circuit of pipes 524 generally located about the interior periphery of the radiant section 504. The convection section 505 primarily utilizes radiant and convective thermal transfer from combustion gases flowing through the generator 500 to heat fluid flowing through a second circuit of pipes 525 that occupy much of the interior volume of the convection section 505. The first circuit of pipes 524 and the second circuit of pipes 525 are connected together to create a continuous combined circuit. In one implementation, the combined circuit flows water to be converted into steam using the heat generated within the generator 500.

The abrupt transition 526 includes a substantial target wall 528, which is a relatively planar surface that fills the cross-sectional surface area of the circular radiant section 504 that does not open into the smaller rectangular convection section 505 inlet (see e.g., a difference in area between circular output 534 and rectangular input 536). In various implementations, the target wall 528 occupies greater than 35% or approximately 50% of the radiant section 504 circular area. The target wall 528 is a source of fatigue and/or wear, conductive heat loss, and negatively affects combustion gas flow through the generator 500.

Figure 5B:
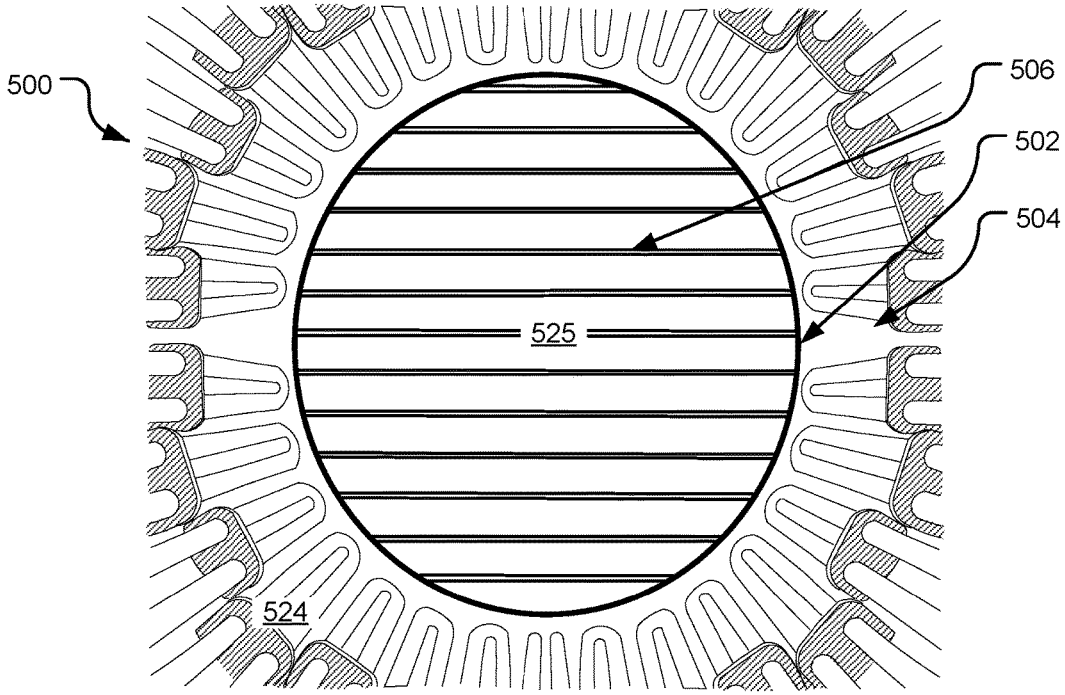
FIG. 5B is an interior view of an example round angled transition attached to a convection section of a steam generator.

FIG. 5B is an interior view of an example round angled transition 502 attached to a convection section 506 of a steam generator. The radiant section 504 primarily utilizes thermal radiation within the generator 500 to heat fluid flowing through a first circuit of pipes 524 generally located about the interior periphery of the radiant section 504. The convection section 506 primarily utilizes thermal convection from combustion gases flowing through the generator 500 to heat fluid flowing through a second circuit of pipes 525 that occupy much of the interior volume of the convection section 506. The first circuit of pipes 524 and the second circuit of pipes 525 are connected together to create a continuous combined circuit. In one implementation, the combined circuit flows water to be converted into steam using the heat generated within the generator 500.

The angled transition 502 includes little, if any, target wall due to the angled transition 502 angling outward to meet the convection section 506 corners. In various implementations, any target wall occupies less than 10% or approximately 0% of the radiant section 504 circular area. As a result, the convection section 506 may have a larger input cross-section as compared to convection section 505 of FIG. 5A without blocking combustion gases from flowing to the corners of the convection section 506.

Figure 6:
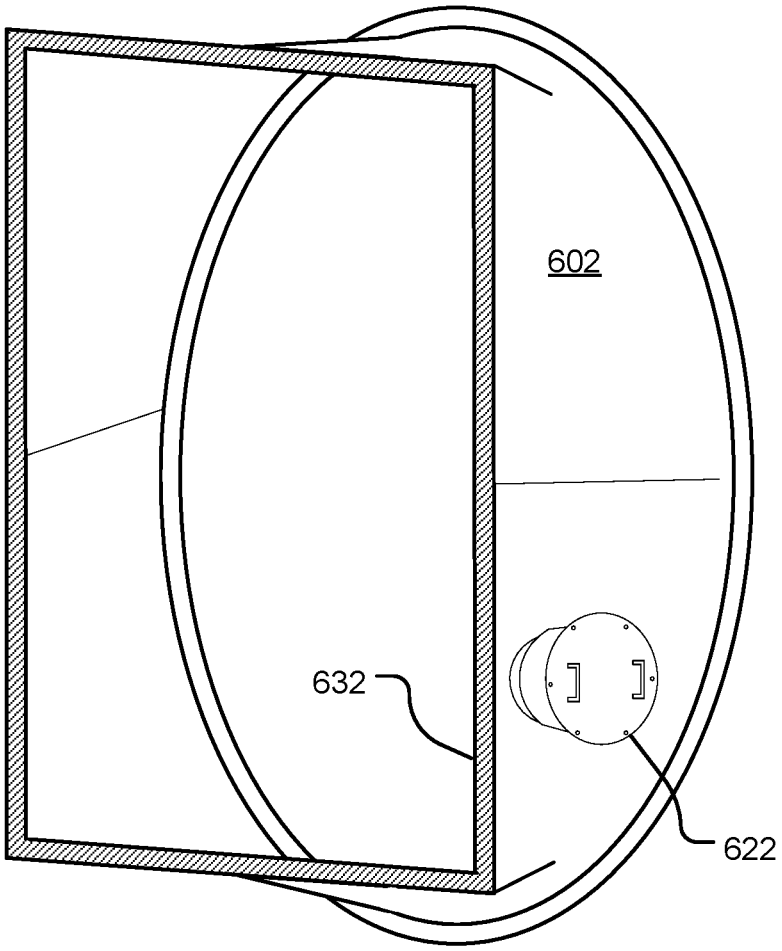
FIG. 6 is a perspective view of an example rectangular to round angled transition.

FIG. 6 is a perspective view of an example rectangular to circular angled transition 602. The transition 602 achieves a smooth circular cross-section to rectangular cross-section transition. Further, the transition 602 includes an access port 622 for maintenance or repair operations. Still further, the transition 602 may include one or more flanged interfaces (e.g., flange 632) to attach the transition 602 to corresponding convection and radiant sections (not shown). The transition 602 is adapted to substantially match to the corresponding convection and radiant sections. By matching the sections, there is less conductive, radiative, and/or convective heat loss at the transitions.

Figure 7:
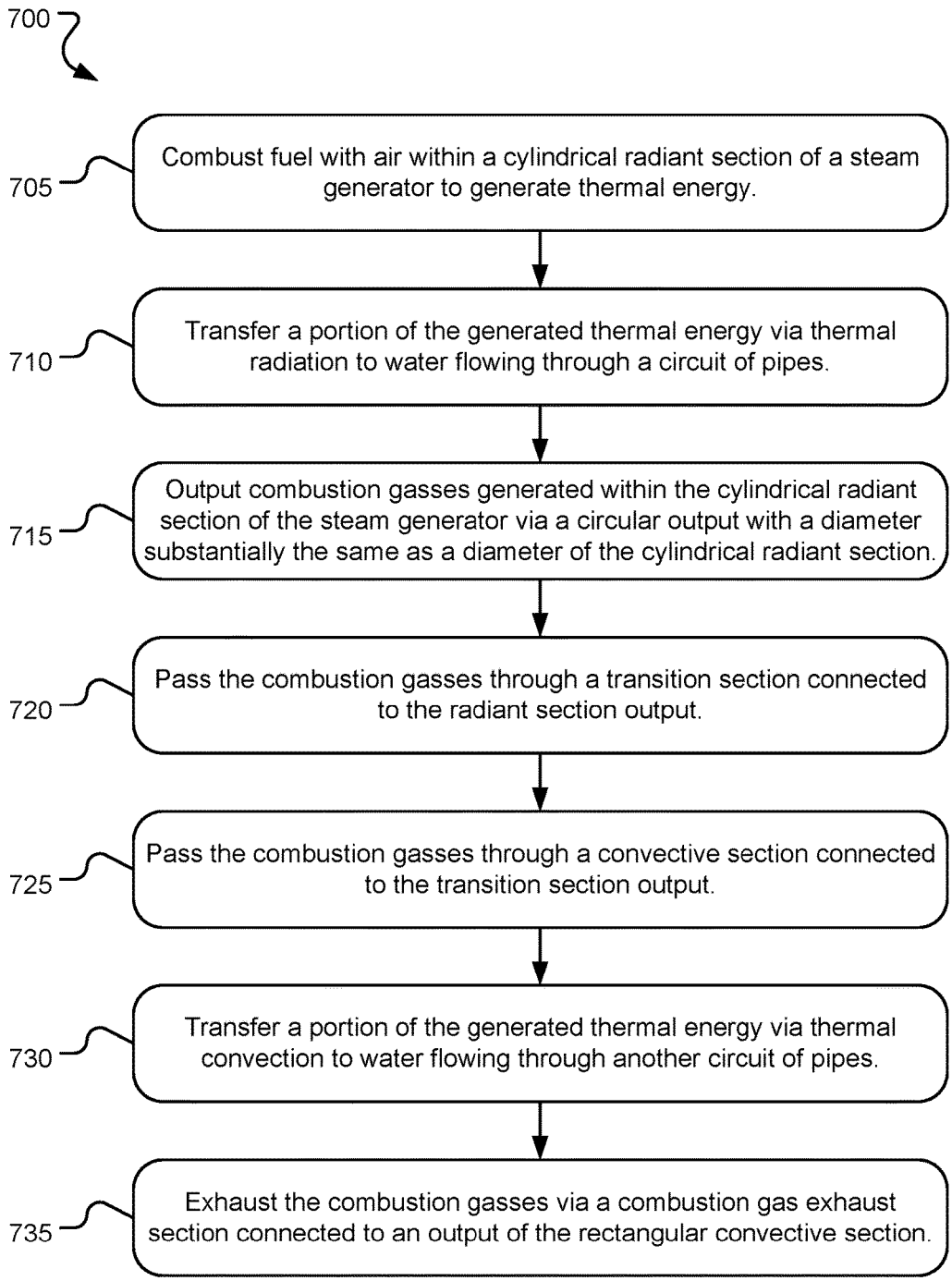
FIG. 7 illustrates example operations for using a steam generator with an angled transition from a radiant section to a convection section.

FIG. 7 illustrates example operations 700 for using a steam generator with an angled transition from a radiant section to a convection section. Combusting operation 705 combusts fuel with air within a cylindrical radiant section of a steam generator to generate thermal energy within the steam generator. In various implementations, the radiant section includes a burner that feeds air and fuel into the radiant section, where the air and fuel are combined and combusted. A fan or blower may supply the air to the burner under pressure.

A first transferring operation 710 transfers a portion of the generated thermal energy via thermal radiation to fluid flowing through a circuit of pipes. The pipes are oriented substantially about an interior periphery of the radiant section. In various implementations, the circuit of pipes is oriented such that it is in a line-of-sight with a flame extending from the burner, thus maximizing thermal radiation from the flame to the fluid within the circuit of pipes. For example, as the liquid-phase water passes through the circuit of pipes, it is heated sufficiently to substantially convert to a gaseous phase (i.e., water vapor). In various implementations, greater than 80% or about 100% of the water is converted to steam. Change of the liquid-phase water to a gaseous-phase is used to for steam injection or to drive additional equipment to generate work or power, for example.

Outputting operation 715 outputs combustion gases generated within the cylindrical radiant section of the steam generator via a circular output with a diameter substantially the same as a diameter of the cylindrical radiant section. In various implementations, the radiant section includes little (e.g., less than 1%, 5%, or 10% of the cross sectional area of the radiant section) to no target wall.

A first passing operation 720 passes the combustion gases through a transition section connected to the radiant section output. The transition section has a circular input with a diameter substantially equal to the diameter of the cylindrical radiant section (e.g., the circular input cross-sectional area of the transition section is within 1%, 5%, or 10% of the cross-sectional area of the cylindrical radiant section). The transition section further has a rectangular output. The transition section smoothly transitions from the circular input to the rectangular output, in some implementations with a diameter of the circular input within 1%, 5%, or 10% of the width or height dimension of the rectangular output.

A second passing operation 725 passes the combustion gases through a convection section connected to the transition section output. In various implementations, the rectangular output of the transition section substantially matches the width and height dimensions of the convection section input within a 1%, 5%, or 10% deviation.

A second transferring operation 730 transfers a portion of the generated thermal energy via thermal convection to fluid flowing through another circuit of pipes. This circuit of pipes substantially fills an interior volume of the convection section and is fluidly connect to the circuit of pipes within the radiant section reference above. For example, liquid-phase water passes through this circuit of pipes and is heated such that it enters the circuit of pipes within the radiant section at a high temperature, but insufficient temperature to gasify the liquid-phase water.

An exhausting operation 735 exhausts the combustion gases via a combustion gas exhaust section connected to an output of the rectangular convection section. The exhaust section exhausts the combustion gases after a desired quantity of thermal energy is removed from the exhaust gases. In various implementations, the exhaust gases are vented directly to atmosphere or are passed through a filtration or treatment system prior to venting to atmosphere.

Figure 8:
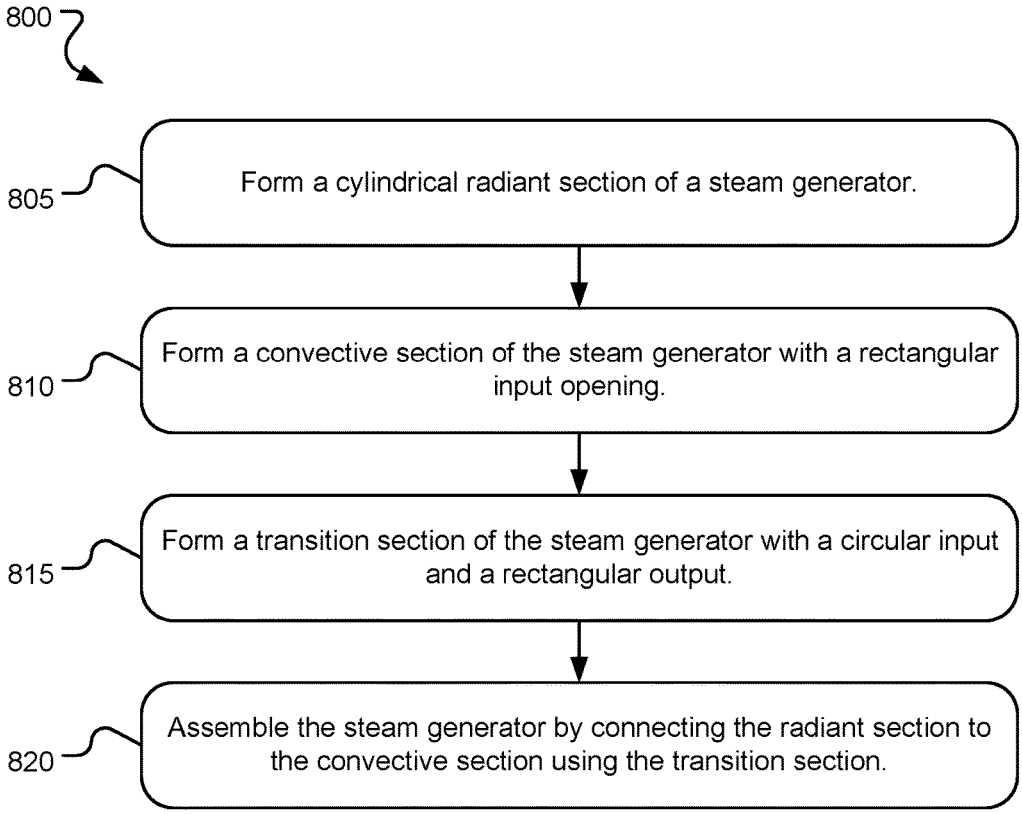
FIG. 8 illustrates example operations for manufacturing an angled transition from a radiant section to a convection section for a steam generator.

FIG. 8 illustrates example operations 800 for manufacturing an angled transition from a radiant section to a convection section for a steam generator. A first forming operation 805 forms a cylindrical radiant section of the steam generator. In one implementation, the radiant section is made of a refractory lined steel shell. The steel shell may be formed by rolling sheet steel into a desired diameter and welding the seam together. Refractory anchors and/or fluid pipe anchors may be welded to some or all of the interior surfaces of the steel shell. Refractory material is applied to the interior of the steel shell, providing a thermally insulating and high temperature resistant radiant section. A first circuit of pipes may be attached to the interior periphery of the radiant section.

A second forming operation 810 forms a convection section of the steam generator with a rectangular opening. The convection section may take the form of a truncated pyramid formed by welding sheets of steel together. In various implementations, refractory anchors and/or fluid pipe supports may be welded to some or all interior surfaces of the convection section. Refractory material and/or ceramic insulation may be applied to some or all of the interior surfaces of the convection section. A second circuit of pipes is attached to the fluid pipe anchors, where the second circuit of pipes substantially fills the interior volume of the convection section.

A third forming operation 815 forms a transition section of the steam generator with a circular input and a rectangular output. The circular input of the transition section substantially matches the diameter of the radiant section of the steam generator. Further, the width and height dimensions of the rectangular output of the transition section substantially match the width and height dimensions of the input of the convection section of the steam generator. The transition section includes a smooth transition from the circular input and the rectangular output. In various implementations, refractory anchors and/or fluid pipe anchors may be welded to some or all interior surfaces of the transition section. Refractory/ceramic fiber insulation material may be applied to some or all of the interior surfaces of the transition section.

An assembling operation 820 assembles the steam generator by connecting the radiant section to the convection section with the transition section there between. The transition section forms a smooth transition between the radiant section and the convection section without substantial obstruction (e.g., without a substantial target wall). Further, the first circuit of pipes and the second circuit of pipes are connected together forming a contiguous circuit of pipes. This occurs either within the transition section or immediately outside the transition section. In other implementations, multiple circuits of pipes may be connected between the radiant section to the convection section.

The logical operations making up the embodiments of the invention described herein are referred to variously as operations, steps, objects, or modules. Furthermore, it should be understood that logical operations may be performed in any order, adding or omitting operations as desired, unless explicitly claimed otherwise or a specific order is inherently necessitated by the claim language.

The above specification, examples, and data provide a complete description of the structure and use of exemplary embodiments of the invention. Since many embodiments of the invention can be made without departing from the spirit and scope of the invention, the invention resides in the claims hereinafter appended. Furthermore, structural features of the different embodiments may be combined in yet another embodiment without departing from the recited claims.

What is claimed is:

1. Fired equipment comprising:

a radiant section having a circular cross-section;

a convection section having a rectangular cross-section, the convection section configured to absorb thermal energy via radiation from a burner flame extending into the radiant section and via convection from combustion gases flowing from the radiant section and through the fired equipment, the convection section reducing in interior cross-sectional area in a downstream direction of the combustion gases flowing through the fired equipment; and a transition section axially aligned with the radiant section and the convection section and connecting the radiant section to the convection section without a target wall.

2. The fired equipment of claim 1, wherein the radiant section is configured to absorb thermal energy primarily via radiation from the burner flame within the fired equipment.

3. The fired equipment of claim 1, wherein the transition section has an input dimension substantially the same as an output dimension of the radiant section, and the transition section has an output area substantially the same as an input area of the convection section.

4. The fired equipment of claim 1, further comprising:

a circuit of pipes configured to flow fluid through the fired equipment and absorb thermal energy generated within the fired equipment into the fluid.

5. The fired equipment of claim 4, wherein a first portion of the circuit of pipes resides about an interior periphery of the radiant section.

6. The fired equipment of claim 5, wherein a second portion of the circuit of pipes occupies an interior volume of the convection section.

7. A steam generator comprising:

a furnace having a circular cross-section;

a convection section having a rectangular cross-section, the convection section configured to absorb thermal energy via radiation from a burner flame extending into the furnace and via convection from combustion gases flowing from the furnace and through the steam generator, the convection section reducing in interior cross-sectional area in a downstream direction of the combustion gases flowing through the steam generator; and a transition section oriented between and axially aligned with the furnace, the transition section connecting the furnace to the convection section without a target wall.

8. The steam generator of claim 7, wherein the convection section is axially aligned with the furnace.

9. The steam generator of claim 7, further comprising:

a circuit of pipes configured to flow fluid through the steam generator and absorb thermal energy generated within the steam generator into the fluid.

10. The steam generator of claim 9, wherein the circuit of pipes substantially fills an output of the transition section.

11. The steam generator of claim 9, wherein the transition section is connected to a circular furnace output, the transition section having a circular input with a diameter substantially the same as the circular furnace output, the transition section further having a rectangular output.

12. The steam generator of claim 11, wherein the rectangular output of the transition section has a height dimension substantially the same as a height dimension of the convection section and a width dimension substantially the same as a width dimension of the convection section.

13. The steam generator of claim 11, wherein one or both of a width and a height of the rectangular output of the transition section is substantially the same as the diameter of the circular furnace output.

14. A method of operating fired equipment comprising:

providing the fired equipment of claim 1;

combusting fuel with air within the radiant section;

outputting combustion gases from the radiant section through the transition section to the convection section;

transferring thermal energy to the convection section via radiation from the burner flame extending into the radiant section; and transferring thermal energy to the convection section via convection from combustion gases flowing from the radiant section and through the fired equipment.

15. The method of claim 14, wherein the transition section has a circular input with a diameter substantially the same as the diameter of the radiant section output, the transition section further having a rectangular output.

16. The method of claim 15, wherein the rectangular convection section has an input height dimension substantially the same as a height dimension of the transition section output and an input width dimension substantially the same as a width dimension of the transition section output.

17. The method of claim 16, further comprising:

exhausting the combustion gases via a combustion gas exhaust section connected to an output of the rectangular convection section.

18. The method of claim 14, further comprising:

flowing fluid through a circuit of pipes running through the fired equipment, where the circuit of pipes is oriented to absorb thermal energy generated within the fired equipment into the fluid.

19. The method of claim 18, wherein the circuit of pipes resides substantially about an interior periphery of the radiant section, further comprising:

transferring thermal energy primarily via thermal radiation from a burner flame to the circuit of pipes within the radiant section.

20. The method of claim 18, wherein the circuit of pipes substantially fills an interior volume of the convection section, and wherein the thermal energy transferred to the convection section via convection from the combustion gases is transferred to the circuit of pipes within the convection section.

* * * * *